United States Patent [19]

Geary et al.

[11] Patent Number: 4,563,987

[45] Date of Patent: Jan. 14, 1986

[54] AUTOMATIC ENGINE CONTROL SYSTEM

[75] Inventors: William C. Geary; Mohammad V. Mirsaiidi, both of Broken Arrow; Timothy Redfern; David W. Wolfe, both of Tulsa, all of Okla.

[73] Assignee: Arrow Specialty Company, Tulsa, Okla.

[21] Appl. No.: 576,033

[22] Filed: Feb. 1, 1984

[51] Int. Cl.[4] ..... F02N 11/08

[52] U.S. Cl. ..... 123/179 B; 123/179 A

[58] Field of Search ..... 123/179 A, 179 B, 179 BG; 290/38 R, 38 C

[56] References Cited

U.S. PATENT DOCUMENTS

| | | | |
|---|---|---|---|
| 2,399,542 | 4/1946 | Collins . | |
| 3,016,690 | 1/1962 | Erickson et al. . | |
| 3,071,125 | 1/1963 | Leaver et al. | 123/179 B |
| 3,246,641 | 4/1966 | Goehring . | |
| 3,478,730 | 11/1969 | Bucher . | |
| 3,514,621 | 5/1970 | Farmer et al. | 123/179 A |
| 3,603,300 | 9/1971 | Moffett . | |
| 3,664,123 | 5/1972 | Zucca et al. . | |
| 3,746,926 | 7/1973 | Sparks . | |
| 3,841,291 | 10/1974 | Ludewig et al. . | |
| 3,866,059 | 2/1975 | Przywozny | 290/38 R |
| 3,875,487 | 4/1979 | White . | |
| 3,886,738 | 6/1975 | Sien . | |
| 3,893,108 | 7/1975 | McBride, Jr. et al. . | |
| 3,938,549 | 2/1976 | Nunneley . | |
| 3,964,567 | 6/1976 | McGinty . | |
| 3,973,550 | 8/1976 | Sparks et al. . | |
| 4,019,489 | 4/1977 | Cartmill . | |
| 4,020,818 | 5/1977 | Lesnick et al. . | |
| 4,038,507 | 7/1977 | Murphy, Jr. et al. . | |
| 4,068,274 | 1/1978 | Murphy, Jr. et al. . | |
| 4,079,432 | 3/1978 | Godfrey . | |
| 4,102,316 | 7/1976 | Valbert . | |
| 4,106,470 | 8/1978 | San Sebastian Saizar . | |
| 4,188,931 | 2/1980 | Waterhouse . | |
| 4,231,073 | 10/1980 | Suchko . | |
| 4,467,615 | 8/1984 | Potjes et al. | 123/179 BG |
| 4,490,620 | 12/1984 | Hansen | 123/179 A |

*Primary Examiner*—Parshotam S. Lall

*Attorney, Agent, or Firm*—Steven L. Permut; Malcolm L. Sutherland; Leon E. Redman

[57] ABSTRACT

An automatic engine control circuit and clutch actuating mechanism includes a primary timer which defines an off time and on time and a starting circuit that includes a second timer mechanism that determines the number of times the engine is cranked the duration in each starting crank. The engine control circuit also has a warm up timer that provides for an engine warm up period before a clutch actuating circuit is actuated to engage a clutch. The clutch actuating mechanism has a shaft with adjustable spring clips that flip limit switches in the clutch actuating circuit. A supplemental timer is operatively connected to the primary timer to allow for warm up periods without engagement of the clutch when the primary timer is in its off mode. Other safety sensors are operatively connected within the circuit to disable the engine if any unsatisfactory conditions are sensed by the circuit.

19 Claims, 6 Drawing Figures

FIG. 2.
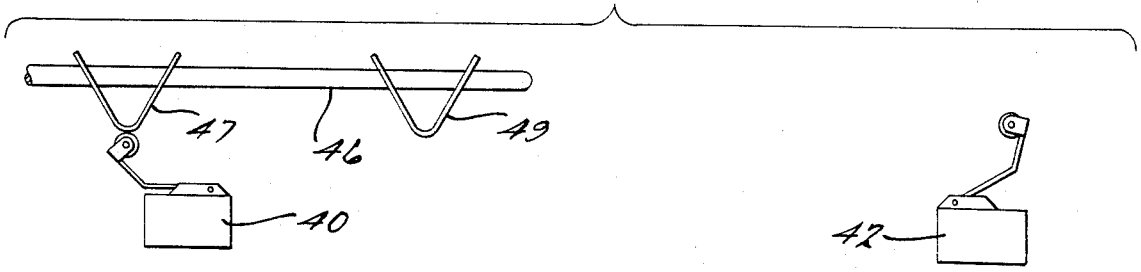
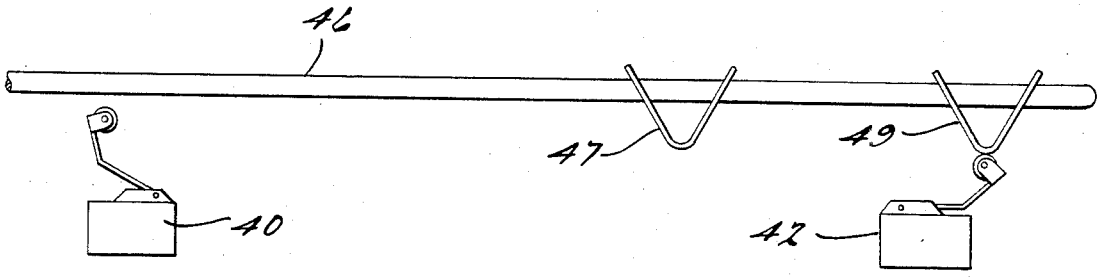
FIG. 3.
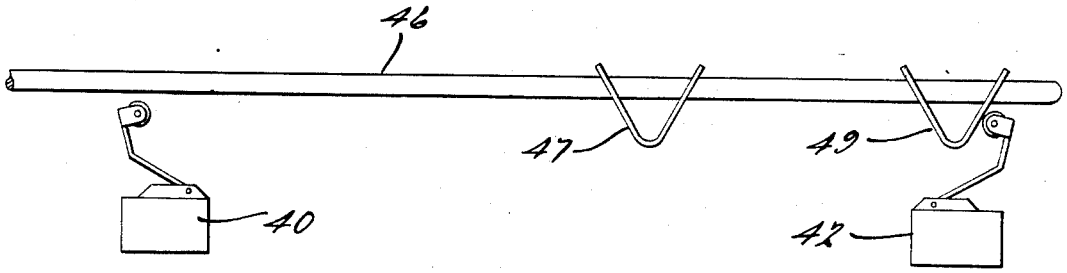
FIG. 4.
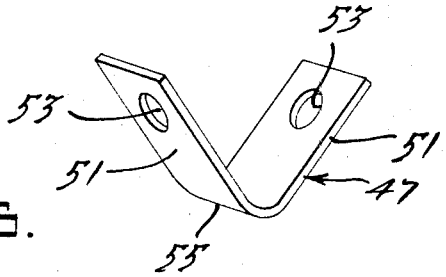
FIG. 5.

AUTOMATIC ENGINE CONTROL SYSTEM

BACKGROUND OF THE INVENTION

Technical Field

This invention relates to a control system for an internal combustion engine and more particularly, with a control system that controls the run time and off time of a remote engine and the actuation of its clutch.

DISCLOSURE INFORMATION

It has long been desirable to have an automatic engine control system and clutch actuator. One application for an automatic engine control system is for stationary engines out in oil fields which must be alternately driven and shut off for predetermined periods of time. Since these engines are often unattended, the automatic control system must not only start and stop the engine but also must disable it until attendance if a malfunction is detected. Various systems have been devised which use a primary timer to automatically start and stop internal combustion engines after predetermined intervals of time. Control systems have also been made to disable the engine if an undesirable oil pressure liquid coolant level, or liquid coolant temperature are detected.

What is needed is a system that can be easily adjusted for varying weather conditions. Furthermore, what is needed is a system that can be easily adapted to various engine models. More specifically, due to extreme weather changes, the distinctive characteristics of a particular engine and other environmental conditions, the desired number of crank attempts for starting the engine and the desired duration of each crank attempt may vary. Furthermore, it may be desired in cold weather conditions that the engine be automatically started for a brief period of time to warm it up during its normally off mode. A system is needed that can accomodate these changes.

Furthermore, what is needed is an engine control and clutch actuator system that will disable the engine if a malfunction in the clutch actuator is detected. The clutch actuator stroke is needed to be adjusted for different engines.

Finally, an engine controller is needed that has a test mode that can start the engine and actuate the clutch by bypassing the primary timer.

SUMMARY OF THE INVENTION

According to one aspect of the invention, an automatic control circuit includes a primary timer for determining alternating first and second time periods with the first time period being designated as when the engine and clutch assembly are allowed to fully operate and the second time period when the engine and clutch assembly are disabled from fully operating. A starter mechanism is responsive to the primary timer for starting the engine near the beginning of each first time period. A clutch actuator is responsive to the primary timer to engage the clutch near the beginning of the first time period. A shut down mechanism is also responsive to the primary timer to disable the engine at the beginning of the second time period.

An optional supplemental timer is responsive to the first timer and determines alternating third and fourth periods of time within the second time period. The starter means is responsive to the supplemental timer for starting the engine at the beginning of each fourth period of time. The shut down means is responsive to the supplemental timer for shutting down the engine during each third time period but is deactuated during each fourth time period.

Another aspect of the invention is directed to an overload sensor which senses the electrical load through the clutch actuator and disables the engine if the electrical load becomes too high.

Another aspect of the invention relates to a starter mechanism that includes an automatic switch which closes for a predetermined amount of time and a limiter mechanism which limits the number of times that the automatic switch closes for allowing the starter motor to start the engine. If the engine is not started within the number of times set by the limiter, an overcrank mechanism disables the engine until proper maintenance and resetting of the engine and control circuit.

Preferably, the automatic switch includes a secondary timer responsive to the primary timer for setting the time between successive cranks of the engine. A third timer being responsive to the secondary timer can be adjustably set for adjustably determining the duration of each crank.

Another aspect of the invention relates to a clutch actuator mechanism having an override switch which can be moved to an automatic or disengaged position. When the override switch is in the automatic position, the clutch actuator is responsive to the primary timer and starting mechanism to engage the clutch near the beginning of each first time period. The switch can also be moved to the disengage position which allows the clutch actuator to disengage the clutch regardless of the engine's mode. Preferably, the override switch also has an on position which allows the clutch actuator to engage the clutch regardless of the engine mode.

One aspect of the invention is related to the clutch actuator having generally V-shaped spring clips adjustably positioned on a moveable actuator shaft which is axially moveable via a clutch actuating motor. The lobes of the V-shaped spring clips are engagable with switch mechanisms which are operably connected to the motor that determines the direction of motion of the actuator shaft.

Preferably the engine control circuit also has sensors for detecting oil conditions and coolant conditions for disabling the engine when the oil and coolant sensors pick up unsatisfactory conditions. Furthermore, it is desirable to have a warm up timer responsive to the primary timer for allowing the engine to run for a brief period of time at the beginning of the first time period before the clutch actuating means engages the clutch.

BRIEF DESCRIPTION OF THE DRAWINGS

Reference now will be made to the accompanying drawings in which:

FIG. 2 is a side elevational view of a clutch actuator mechanism according to the invention in the disengaged position.

FIG. 3 is a view similar to FIG. 2 disclosing the clutch actuator moved until pressing against switch 42.

FIG. 4 is a view similar to FIG. 3 disclosing the clutch actuator in the fully engaged and backed off position.

FIG. 5 is an enlarged perspective view of a spring clip shown in FIGS. 2–4.

DETAILED DESCRIPTION OF THE PREFERRED EMBODIMENTS

Figure 1:
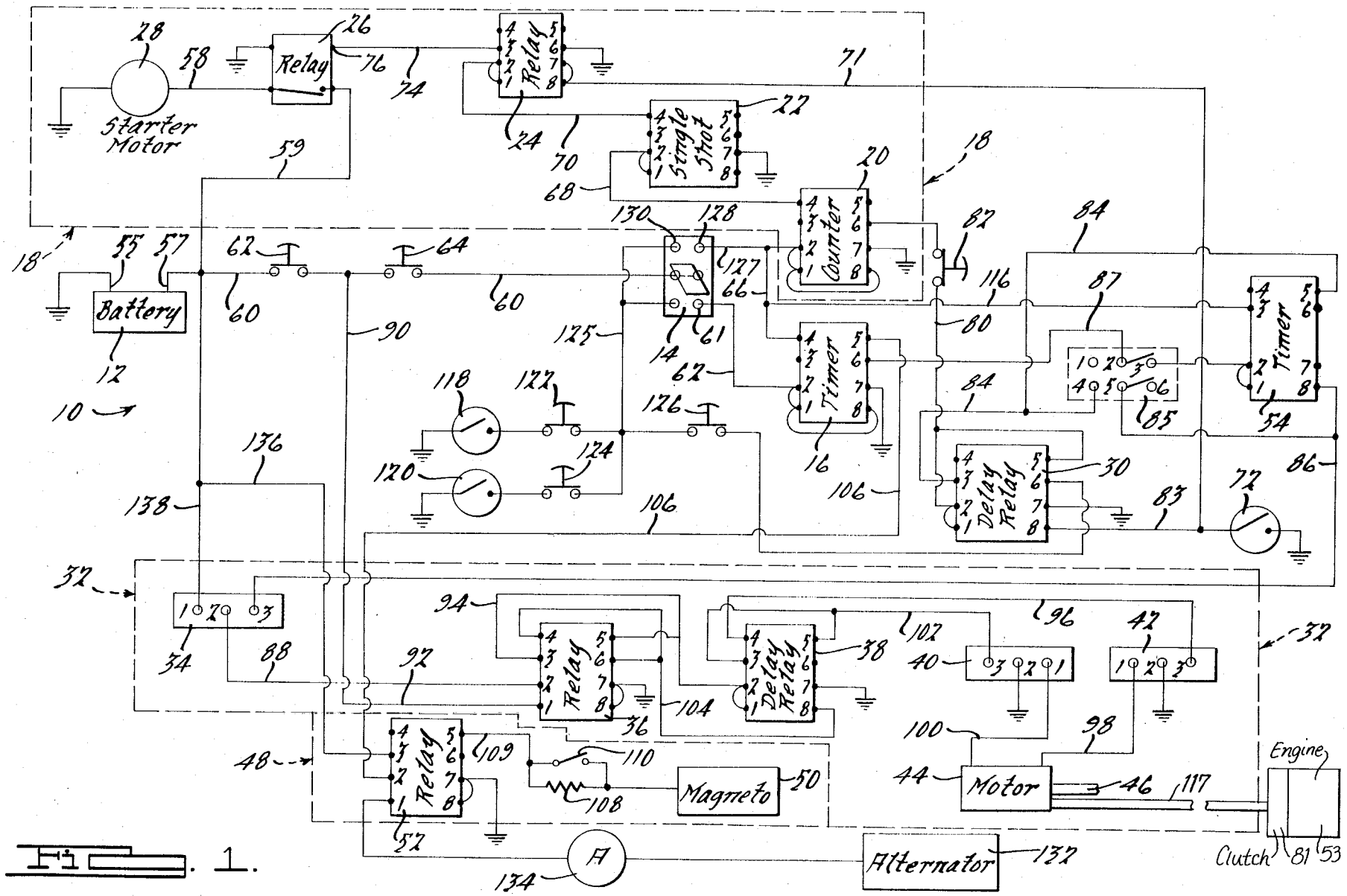
FIG. 1 is a block diagram of an embodiment of an engine control circuit according to the invention illustrating the interrelationship of the various components of the circuit.

Referring to FIG. 1, an engine automatic control circuit 10 in general has a battery 12, main switch 14, and a primary recycle timer 16. The primary timer 16 is operatively connected to a starting circuit 18 which includes a second timer-counter 20, a third timer 22, a safety relay 24 and primary relay 26 connected to a starter motor 28.

The primary timer 16 is connected to a warm-up delay relay 30 which in turn is operatively connected to the clutch actuation circuit 32 which includes an override clutch switch 34, a relay 36, and a delay relay 38. The relays 36 and 38 are connected to two limit switches 40 and 42, which are connected to an actuator motor 44. The motor 44 axially moves shaft 46 as shown in more detail in FIGS. 2–4.

The primary timer 16 is also operatively connected to the shut-down circuit 48 which includes a magneto 50 connected through a relay 52 which can selectively ground the magneto to shut off the engine 53. In addition, the primary timer 16 is connected to a supplemental timer 54 which in turn is also operatively connected to the starting circuit 18.

In more detail, the battery has a grounded negative terminal 55 and a positive terminal 57 connected via line 59 directly to relay 26 of the starter circuit 18. The relay 26 is normally in an open position and has an output line 58 connected to the starter motor 28.

The battery 12 also has its positive terminal 57 connected to main switch 14 via the line 60. Line 60 has an overload circuit breaker 62 which has a capacity of 10 amps and a main circuit breaker 64 which has a capacity of 3 amps. The main switch 14 is a double pull double throw off center toggle switch which can be positioned in an automatic mode, a test mode or in an off position.

When in the automatic mode, the switch 14 connects line 60 to to terminal 61 at end of line 62 which is connected at its other end to the actuation terminal 2 of primary timer 16. The primary timer 16 is internally wired such that its actuation terminal 2 is connected to an internal timer relay (not shown). The timer relay allows an internal solenoid (not shown) to be connected to both terminal 2 and grounded terminal 7 and thus be cyclically actuated and deactuated for alternating periods of time. In other words, the primary timer 16 operates such that when switch 14 is positioned in its automatic mode, line 62 receives an electrical signal. The internal timer responds to the electrical signal and starts off without the solenoid being actuated. This mode allows for the first period of time which the engine 53 can be started and operated. When the solenoid is actuated after the preset first time period, the circuit is in an off mode during a second adjustable period of time. One acceptable timer on the market that provides this cycling function is timer relay 368 12-1 min. manufactured by Signaline. The primary timer 16 as with most of the other timers and relays are internally wired such that terminal 1 makes electrical contact with either terminal 3 or 4 and terminal 8 makes electrical contact with either terminal 5 or 6 depending if the solenoid inside each timer and relay is actuated or not. If not actuated, the solenoid allows contact from terminals 1 and 8 to 4 and 5 respectively and when actuated, the solenoid allows contact from terminals 1 and 8 to 3 and 6 respectively. Terminal 2 of primary timer 16 is also connected to terminal 1 which in turn is connected to terminal 8.

During the first period of time, an electrical signal passes from terminal 1 to terminal 4 of the primary timer 16 and to the starter circuit 18 and more specifically, to actuation terminal 2 of the timer-counter 20 via line 66. In like fashion, terminal 2 of timer-counter 20 is attached to grounded terminal 7 through an internal timer and two internal solenoids (not shown) and cyclically actuates the first solenoid after an adjustable delay. Terminal 2 is jumped to terminal 1 and terminal 8. The timer-counter has an internal wiring with two relays therein. The terminal 1 is in contact with either terminal 3 or 4 depending on the actuation of the first solenoid. Terminal 8 is in contact first with terminal 5, and then after certain number of cycles of the first solenoid, the second solenoid is actuated which contacts terminal 8 with terminal 6. A timer-counter that is suitable for the purpose of this circuit is counter SG237,12DC (3–60 second) manufactured by Electromatic.

The electric signal for example of 25 second duration, is sent from terminal 4 of counter 20 to a third timer 22 commonly referred to as a single shot relay via line 68. A suitable single shot relay is part number 362-12-1 sec. manufactured by Signaline. The single shot relay 22 has its terminal 2 wired to terminal 1. Terminal 1 of relay 22 is in communication with terminal 3 immediately upon actuation of the relay 22, for the adjustable predetermined amount of time, for example, six seconds. The six second electrical signal from terminal 3 is sent to actuation terminal 2 of safety relay 24, via line 70. Terminal 2 is jumped to terminal 1 as with the previous relays and counters. However, terminal 7 which is normally grounded in the other terminals is then jumped to terminal 8 which in turn is connected via line 71 to an oil pressure gauge 72 which has a switch closed to ground if the oil pressure registers zero. Therefore, relay 24 will only be actuated if the oil gauge reads zero and thus prevents any cranking of the engine if the engine is already turning and causing oil pressure above zero. If the relay 24 is actuated, contact between terminal 8 and grounded terminal 6 occurs to allow the relay 24 to remain actuated once oil gauge switch 72 is opened. When the relay 24 is actuated, terminal 1 is connected to terminal 3 which feeds signal through line 74 to the relay control terminal 76 which closes the relay 26 to allow the power from battery 12 to pass through line 59. After the 6 second duration through line 70, the single shot relay 20 becomes deactuated for the remainder of the cycle time of the second counter-timer 20.

The counter-timer 20 then cycles again and sends a second signal via line 68 to reactuate single shot relay 22 to send another 6 second signal along line 70. If perchance the first 6 second crank of the starter motor 28 did not start the engine and the engine has rested within the 25 second cycle, the relay 24 allows a second signal to pass through line 58 and close the relay 26. If the engine started during the previous 6 second crank attempt, the oil pressure than reads above zero and the relay 24 disconnects line 74 from live terminal 1 to prevent relay 26 to close and prevents the starter motor 28 from further cranking.

The counter-timer 20 successively sends a twenty-five second signal for an adjusted set number of times for example, six times. After the sixth time, the second solenoid inside counter 20 actuates to allow terminal 8 to contact terminal 6 which is connected to terminal 1. Terminal 6 is connected to line 80 that has a 3 amp capacity overcrank circuit breaker 82 in line. Line 80 is connected to terminals 2 and 5 of the warm up delay relay 30. Terminal 5 of the warm up delay relay 30 is initially in contact with terminal 8 which in turn is in contact with the oil gauge switch 72 through line 83. If the engine did not start after the predetermined number of crank attempts, the oil gauge switch 72 remains closed and the overcrank circuit breaker 82 becomes grounded through line 83 causing an overload through breaker 82 and main cirucuit breaker 64. The breakers 64 and 82 pop open and cut the main power source to the rest of the circuit and prevent any further operation of the circuit 10.

If the engine is successfully started, but the oil pressure is still inadequately low, the overcrank circuit breaker 82 still opens along with the main circuit 64. Therefore, these open breakers 62 and 84 indicate that the engine is not in a condition to commence running.

If the engine is successfully started and the oil pressure is adequate, terminal 5 of warm up delay relay 30 remains ungrounded and the overcrank circuit breaker 82 remains closed which maintains an active signal to actuation terminal 2 of the warm up delay relay 30. The delay relay 30 can be set for a period of approximately six minutes (called a warm up period, a sufficient period of time to allow the engine 53 to run without engagement of the clutch 81.)

After the six minute period, the internal solenoid (not shown) within delay relay 30 is actuated which contacts terminal 1 to terminal 3. A signal is sent along line 84.

Line 84 is connected to both terminal 4 of switch 85 and to terminal 5 of the supplemental timer 54. The supplemental timer 54 has its terminal 2 connected to terminal 3 of a switch 85. Terminal 2 of switch 85 is connected via line 87 to terminal 6 of the primary timer 16. Terminal 2 in timer 54 is wired to terminal 1 of timer 54. Terminal 8 is wired to line 86 which is also connected to terminal 5 of switch 85. When the supplemental timer 54 is connected to circuit 10, the switch 85 has its terminal 2 in contact with terminal 3 and terminal 5 disconnected from terminal 4. If the supplemental timer 54 is not in the circuit 10, switch 85 is moved such that terminal 4 is contacting terminal 5. Terminal 3 of the supplemental timer 54 is in contact with both terminals 4 and 5 of the primary timer 16 and line 106 via branch 116. The signal along line 84 passes from terminal 5 to terminal 8 in supplemental timer 54 which is connected via line 86 to the clutch actuating override switch 34.

The switch 34 can be in an open position (as shown), an automatic position which connects terminals 2 and 3, or a manual position which connects terminal 1 and 2. If the clutch switch 34 is in the automatic position, the signal from line 86 is then sent via line 88 to actuating terminal 2 of relay 36. Terminal 1 of relay 36 is connected to line 60 downstream from the actuator circuit breaker 62 via line 90 and branch 92. The relay 36 is immediately actuated such that terminal 1 therein contacts terminal 3 which is connected via line 94 to an operative delay relay 38. Actuating terminal 2 of relay 38 is connected to terminal 1 which initially contacts terminal 4. The operative delay relay 38 has a delay of approximately eight seconds before the solenoid therein actuates. The signal from line 94 and to terminal 1 in delay relay 38 emanates from terminal 4 for eight seconds via line 96 to terminal 3 of limit switch 42.

Each limit switch 40 and 42 has a common terminal 1 that can contact either terminal 2 or terminal 3. When switch 42 is released as shown in FIG. 2, terminal 1 contacts terminal 3. When switch 42 is depressed as shown in FIG. 3, terminal 1 contacts terminal 2. Switch 40 is identical to switch 42 and has its terminal 1 likewise contact terminal 3 when its depressed as shown in FIG. 2 and has its terminal 1 contact terminal 3 when its released as shown in FIG. 3.

Switches 40 and 42 are depressed by a pair of spring clips 47 and 49 adjustably mounted on shaft 46. Spring clip 47 is generally V-shaped with two legs 51 each having an aperture 53 and a central lobe section 55. The apertures 53 are sized such that when the legs 51 are flexed toward each other, the shaft 46 is slidable through apertures 53 and when the spring clip 47 is unflexed, each shaft 46 is frictionally engaged to each leg 51. Spring clip 49 is identical to spring clip 47.

Motor 44 axially moves shaft 46 as a motor 44 engages the clutch 81 such that shaft 46 and its clips 47 and 49 function as a servo. The motor 44 can engage the clutch 81 in a conventional fashion via shaft 46 or via a separate shaft 117 mounted in parallel to shaft 46 for motion therewith. The clips 47 and 44 are positioned on shaft 46 such that in FIG. 2, the clutch is fully disengaged, in FIG. 3 the clutch is overly pressed, and in FIG. 4 the clutch is fully engaged.

The signal from line 98 goes to terminal 1 of switch 42 is connected to line 98 of actuator motor 44. Line 100 of motor 44 extends to common terminal 1 of limit switch 40. Limit switch 40, initially pressed as shown in FIG. 2, has its terminal 1 grounded through terminal 2. The motor 44 is thus powered to initially move shaft 46 to the right as shown in FIGS. 1 and 2.

As shaft 46 moves, the switch 40 is released to allow its terminal 1 to make contact with terminal 3 therein. Terminal 3 is also grounded by being in contact with terminal 5 of delay relay 38 via line 102. Terminal 5 is in contact with terminal 8 which is via line 104 in contact with terminal 6 of relay 36. Terminal 6 is in contact with terminal 8 therein. Terminal 8 is in contact with grounded terminal 7.

The actuator motor 44 then continues to move the shaft 46 to the right until the switch 42 is depressed as shown in FIG. 3. The switch 42 as shown in FIG. 3 has terminal 1 disconnected from live terminal 3 and has terminal 1 contact grounded terminal 2 which temporarily stops the actuator motor 44. The time with which the shaft 46 moves from the FIG. 2 position to the FIG. 3 position is within the eight second interval determined by the operative delay relay 38.

The operative relay 38 is then actuated such that its terminal 1 is then in contact with terminal 3 and terminal 8 is disconnected from terminal 5. In this actuated mode, the positive signal from line 94 goes to terminal 3 in delay relay 38 and through line 102 to terminal 3 in switch 40 which is in contact to terminal 1. The positive signal passes through line 100 to motor 44 and back through line 98 which is grounded through terminal 1 and terminal 2 of switch 42. The actuator motor 44 is thus reversed. The shaft 46 then moves to the left a small amount until it achieves the position shown in FIG. 4 at which time switch 42 is released and the terminal 1 is disconnected from grounded terminal 2 and reconnected with terminal 3 which connects to ungrounded terminal 4 in operative delay relay 38. The clutch actuator then stays in the FIG. 4 position for as long as the engine is properly running.

The shut down circuit 48 is responsive to primary timer 16. Primary timer 16 has its terminal 5 connected to actuating terminal 2 of relay 52 via line 106. Grounded terminal 7 of relay 52 is wired to terminal 8 which is normally in contact with terminal 5. Terminal 5 of relay 52 is in contact through resistor 108 in line 109 to magneto 50. Line 109 has a bypass switch 110 bypassing resistor 108. Switch 110 is open when a solid state ignition is used and is closed when a magneto ignition system is used.

Power supplied from terminal 5 of the primary timer 16 via line 106 to the actuating terminal 2 of the shut off relay 52 actuates the relay's internal solenoid. As long as relay 52 is actuated, terminal 5 which is connected to the magneto 50 remains ungrounded and therefore cannot kill the engine.

At the end of the first period of time and the beginning of the second period of time, the primary timer 16 has its internal solenoid actuated. Terminals 1 and 8 of primary timer 16 are disconnected from terminals 4 and 5 and connected to terminals 3 and 6 respectively. Consequently, power is cut off from terminal 2 of relay 52 to allow the terminal 5 to be grounded through terminals 8 and 7 thereby grounding the magneto 50 and killing the engine.

Simultaneously, power is cut from terminal 5 of primary timer 16 to deactuate and reset timer-counter 20 and single shot relay 22. Terminal 6 of timer-counter 20 is therefore disconnected from power which deactuates and resets warm up delay relay 30. Consequently lines 84, 86 and 88 have no electrical signals. Relay 36 is deactuated with terminals 4 and 5 contacting terminals 1 and 8. Line 94 therefore ceases to send an electrical signal to actuating terminal 2 of delay relay 38 and delay relay 38 is deactuated and reset with its terminals 4 and 5 contacting its terminals 1 and 8 respectively.

In this position the signal passing from lines 90 and 92 pass through terminals 1 and 4 in relay 36, line 104, terminals 8 and 5 in relay 38, line 102 through switch 40, line 100 and to motor 44. Return line 98 is grounded through terminal 2 in switch 42 so that motor 44 is reactuated in the reverse direction to disengage the clutch. The motor 44 continues to withdraw shaft 46 until switch 40 is pressed and live terminal 3 is disconnected from terminal 1.

The engine remains off until primary timer 16 recycles to the first time period unless switch 85 is closed to connect terminal 2 to terminal 3. In this condition, the supplemental timer 54 restarts the engine for a brief period of time during the interval in which the primary timer 16 is in the off mode. During the second period of time, if the supplemental timer 54 is connected and switch 85 is positioned to connect its terminal 2 to terminal 3, the primary timer 16 sends a signal along line 87 through switch 85 to actuating terminal 2 of the supplemental timer 54. The timer 54 starts cycling as long as the primary timer 16 is in its off mode. At first the timer 54 is in its off mode defining a third period of time within the second time period in which the engine is off. After this third period of time, the supplemental timer 54 then has its solenoid actuated to define a fourth period of time within the second time period. During this fourth time period, terminals 4 and 5 of timer 54 contact terminal 3 and 6 to allow a signal to be transferred to line 116 and line 106 to the actuating terminal 2 of the shut down relay 52 which ungrounds the magneto as described before.

Simultaneously, the signal alone 116 is transferred via line 66 to the actuating terminal 2 in time-counter 20 to restart the starting circuit 18 in the same fashion as described before. The engine then runs during for an interval until the supplemental timer 54 reverts back to its off mode at which time the signal is cut off from branch 116 and line 106 to ground the magneto 50 and shut down the engine. The actuating circuit 32 is not actuated during the fourth time period.

The circuit has a coolant level sensor switch 118, a coolant temperature sensor switch 120 and corresponding circuit breakers 122 and 124 connected to switch 14 so the electric signal is sent therethrough along line 125. Line 125 receives its signal from closed terminal 127 of main switch 14. If the coolant level and coolant temperature sensors indicate too low a level of coolant or too high of a temperature coolant, the respective switches 118 and 120 become grounded and thereby open the 3 amp breakers 122 or 124 along with the main circuit breaker 64.

Furthermore, if the oil sensor indicates insufficient oil pressure after the warm up period, an oil circuit breaker 126 connected to line 125 along with main circuit breaker 64 become grounded and therefore pop open.

As long as the main circuit breaker 64 remains open, power is no longer fed to the primary timer 16 which thereby cuts off power through line 106 and allows the magneto 50 to become grounded and disable the engine. When the engine becomes disabled, actuator circuit 32 disengages the clutch as described before. The engine remains disabled until attended by an operator.

Other features of circuit 10 include the main switch 14 being moved to a test position which allows the engine to start regardless of the mode of the primary timer 16. This is accomplished by having contact 128 closed when switch 14 is moved to its test position. Line 127 leads directly from the test terminal 128 to the counter-timer 20 of starting circuit 18 which starts the engine as described before. The safety circuit breakers 122, 124 and 126 remain operative by being connected through closed terminal 130 of switch 14 when in the test position.

In addition, the alternator 132 is attached through an ammeter 134 to terminal 1 of the relay 52. Terminal 1 is connected to terminal 3 when the relay 52 is actuated which in turn is attached to line 136 and line 60 which is in communication with positive terminal 57 of battery 12 and also the remainder of the circuit 10. When the engine is shut off, the relay 52 disconnects terminal 1 from terminal 3 so that the battery has no drain through the alternator 132.

Another feature of the circuit 10 allows the clutch actuating circuit 32 to actuate responsive to primary timer 16 or to be independent of timer 16. If terminal 2 of the switch 34 is in communication with the automatic terminal 3, the clutch engagement is automatic as described above. However, if the switch is moved such that terminal 2 is in contact with terminal 1 of the switch 34, the clutch actuating means is in direct communication via line 138 to positive terminal 57 of battery 12. The clutch actuating mechanism is no longer dependent upon the primary timer 16 or warm up timer 30 and engages the clutch as described above. When the switch is open, the clutch actuating mechanism reverses as described above to disengage the clutch regardless of the mode of primary timer 16.

Figure 6:
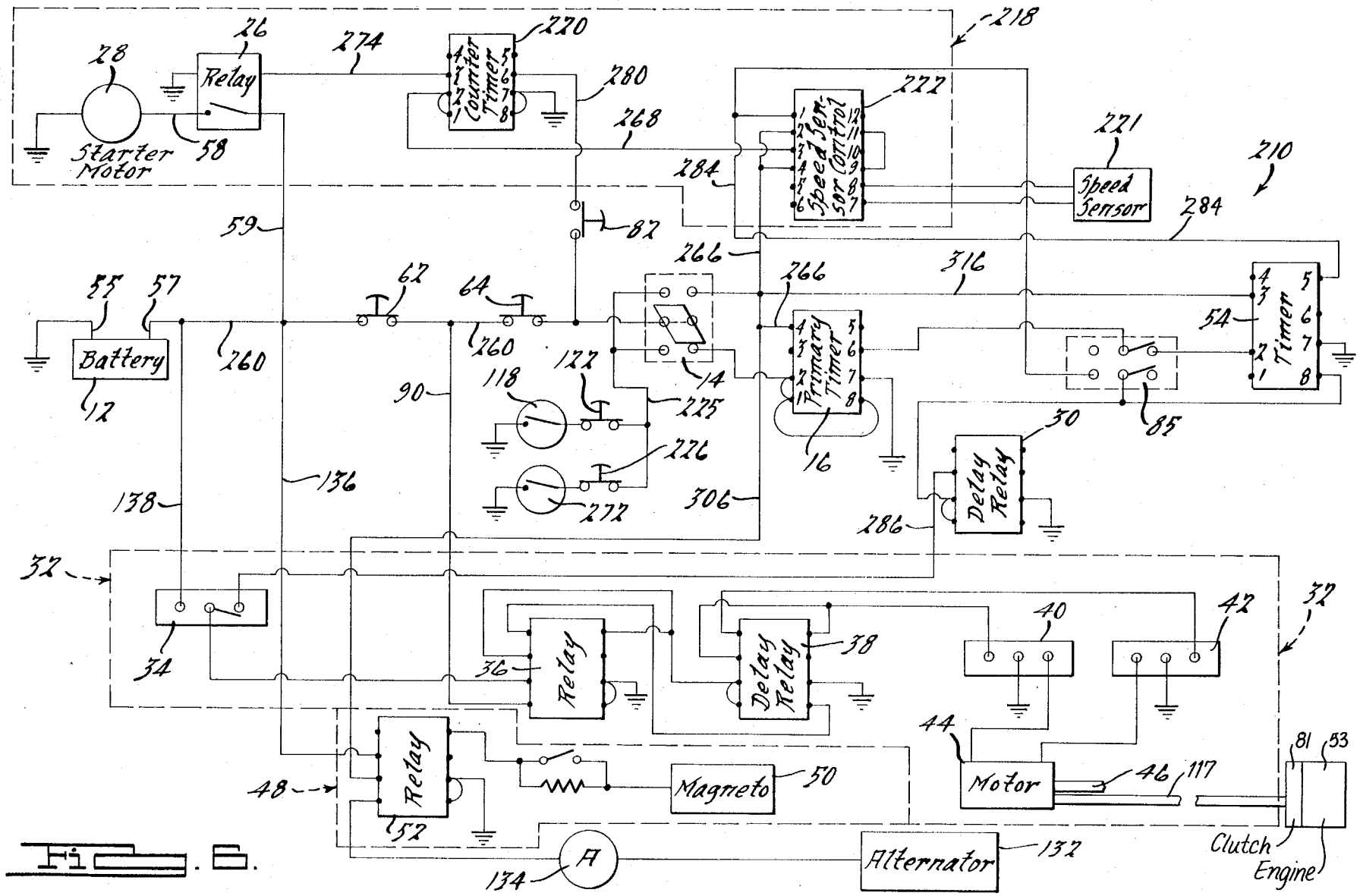
FIG. 6 is a view similar to FIG. 1 of an alternate embodiment of the invention.

Referring to FIG. 6, an alternative engine automatic control circuit 210 is shown. The circuit 210 in general has a battery 12, main switch 14, and a primary recycle timer 16 as described for the first embodiment. The primary timer 16 is operatively connected to a starting circuit 218 which includes a speed sensor control 222, counter-timer 220, and a primary relay 26 connected to a starter mtor 28.

The primary timer 16 is connected to a warm-up delay relay 30 which in turn is operatively connected to the clutch actuation circuit 32 in the same fashion as described for the first embodiment.

The primary timer 16 is also operatively connected to the shut-down circuit 48 in the same fashion as described for the first embodiment through line 306. In addition, the primary timer 16 is connected to supplemental timer 54 which in turn is also operatively connected to the starting circuit 218.

In more detail, the battery has a grounded negative terminal 55 and a positive terminal 57 connected via line 59 directly to relay 26 of the starter circuit 18. The relay 26 is normally in an open position and has an output line 58 connected to the starter motor 28. The battery 12 also has its positive terminal 57 connected to main switch 14 via the line 260 with overload circuit breaker 62 a main circuit breaker 64 in line 260 in similar fashion to the first embodiment.

When in the automatic mode, the switch 14 connects line 60 to terminal 61 at end of line 62 which is connected at is other end to the actuation terminal 2 of primary timer 16.

During the first period of time, an electrical signal passes from terminal 1 to terminal 4 of the primary timer 16 and to the starter circuit 218 and more specifically, to actuation terminals 2 and 4 of the speed sensor control 222 via line 266. Terminals 7 and 8 of speed sensor control 222 are attached to a speed sensor 221. Terminal 9 is jumped to terminal 11. The speed sensor control 222 has its terminal 2 in contact with either terminal 1 or 3 depending on the speed of the engine sensed by speed sensor 221. The speed sensor has terminal 3 in contact with terminal 3 if the speed of the engine is less than about 30 rpm. Above 30 rpm, the terminal 3 contacts terminal 1. A suitable speed sensor control 221 is manufactured by Electra listed under TW 12 Series. A suitable speed sensor 221 is also manufactured by Electra as part 3030AN.

Terminal 3 of speed sensor control 222 is connected to line 268 which is connected to actuation terminal 2 of counter 220 which is identical to timer-counter 20 described in the first embodiment but serves a different function as described below. Terminal 3 of counter 220 is connected through line 274 to main relay 26. Terminal 6 of counter 220 is connected to line 280 which is connected to line 260. An overcrank circuit breaker 282 is in line 280.

In operation, when primary timer 16 sends an electrical signal along line 266, speed sensor control 222 functions as a safety control and prevents a signal from proceedng to the remainder of starting circuit 18 until the engine sufficiently slows down indicating it is not actively running. If the engine is slower than 30 rpm or stopped, a signal passes from terminal 2 to terminal 3 and line 268. Counter 220 is set to be actuated after a predetermined delay for example 20 seconds. Once actuated, the counter 220 is set to remain actuated for a set time e.g., 6 seconds such that terminal 1 makes contact with terminal 3 and a signal is then sent through line 274 to relay 26 to close it and allow starter motor 28 to crank.

If the engine starts to run during the 6 second crank attempt, the speed sensor then disconnects terminal 2 from terminal 3 and the counter 220 is deactuated, thereby deactuating relay 26 and starter 28.

After the 6 second duration through line 274, the counter 220 becomes deactuated for the preset 20 second off time to deactuate line 274, relay 26 and starter 28.

If perchance the first 6 second crank of the starter motor 28 did not start the engine and the engine never goes above the 30 rpm level and counter 20 remains actuated to cycle again. The relay 24 allows a second 6 second signal to pass through line 274 and close the relay 26 after the preset 20 second delay.

The counter-timer 20 successively sends a six second signal until the engine finally starts or until an adjusted set number of times for example, six times is reached. After the sixth time, if the engine still hasn't started the second solenoid inside counter 220 actuates to allow terminal 6 to contact terminal 8 which is connected to grounded terminal 7. This allows a signal to be grounded from line 260 through main breaker 64, line 280, and overcrank circuit breaker 82 causing an overload through breaker 82 and main circuit breaker 64. The breaker 64 and 82 pop open and cut the main power source to the rest of the circuit and prevent any further operation of the circuit 10.

If the engine is successfully started, terminal 6 of counter 220 remains ungounded and the overcrank circuit breaker 82 and main circuit breaker 64 remains closed which maintains an active signal to speed sensor control 222. The signal is sent to terminal 1 which is connected to terminal 5 of supplemental timer 54. Terminal 5 of supplemental timer is in contact with terminal 8 which is in contact with actuation terminal 2 of warm up delay relay. Warm up delay relay works in the same fashion as described for the first embodiment to delay a signal along line 286 to switch 34 of actuating circuit 32 for a period of about six minutes.

At the end of the first period of time and the beginning of the second period of time, the primary timer 16 has its internal solenoid actuated. Terminals 1 and 8 of primary timer 16 are disconnected from terminals 4 and 5 and connected to termnals 3 and 6 respectively. Consequently, power is cut off from terminal 2 of relay 52 to allow the terminal 5 to be grounded through terminals 8 and 7 thereby grounding the magneto 50 and killing the engine.

Simultaneously, power is cut from terminal 4 of the primary timer 16. Therefore line 284 from terminal 1 of speed sensor control 222 is deactuated which deactuates and resets warm up delay relay 30. Consequently, clutch actuator circuit 32 disengages as in the first embodiment.

The engine remains off until primary timer 16 recycles to the first time period unless switch 85 is closed to connect terminal 2 to terminal 3. In this condition, the supplemental timer 54 restarts the engine for a brief period of time during the internal in which the primary timer 16 is in the off mode. The supplemental timer 54 is connected to switch 85 as described in the first embodiment. Terminal 3 of the supplemental timer 54 is in contact with line 216 via branch 316. As can be seen, supplemental timer reactuates starting circuit 218 in the same fashion as described before.

The circuit has a coolant level sensor switch 118, and corresponding circuit breakers 122 connected to switch 14 so the electric signal is sent therethrough along line 225. If the coolant level sensor indicates too low a level of coolant, the switch 118 becomes grounded and thereby opens the 3 amp breaker 122 along with the main circuit breaker 64.

Furthermore, if an oil level sensor 272 indicates insufficient oil level, an oil circuit breaker 226 connected to line 225 along with main circuit breaker 64 become grounded and therefore pop open.

Variations and modifications of the present invention are possible without departing from its spirit and scope as defined by the appended claims.

The embodiments of the invention in which an exclusive property or privilege is claimed are defined as follows:

1. An engine automatic control circuit for an internal combustion engine and clutch assembly, said circuit comprising:

first timer means for determining alternating first and second periods of time, such that said first period of time being when the engine is allowed to run and the clutch is allowed to be engaged and said second period of time being when the clutch is automatically disengaged;

starter means responsive to said first timer means for starting the engine near the beginning of each first period of time;

clutch actuating means responsive to said first timer means for engaging the clutch near the beginning of each first period of time after said starter means starts said engine;

shut down means responsive to said first timer means for shutting off the engine during the second period of time;

said clutch actuating means being responsive to said first timer means for disengaging the clutch at the beginning of each second period of time;

supplemental timer means for determining alternating third and fourth periods of time within said alternate second period of time such that said third period of time being when the engine is shut off and said fourth period of time being when said engine is allowed to run with said clutch remaining disengaged;

said starter means responsive to said supplemental timer means for starting the engine near the beginning of each fourth period of time; and said shut down means responsive to said supplemental timer for shutting the engine off at the beginning of each third period of time and being deactuated during each fourth period of time and first period of time.

2. An engine automatic control circuit as defined in claim 1 further comprising:

a warm up timer means responsive to said first timer means for allowing the engine to run for a warm up period of time at the beginning of said first time period before said clutch actuating means engages said clutch;

said clutch actuating means responsive to said warm up timer means for engaging said clutch after said warm up period of time.

3. An engine automatic control circuit as defined in claim 1 further comprising:

a liquid coolant sensor for sensing coolant in said engine;

an oil sensor for sensing said oil in said engine;

means for disabling said engine when said liquid coolant sensor or said oil sensor sense an undesirable condition of said respective liquid coolant or oil.

4. An engine automatic control circuit as defined in claim 1 further comprising:

an overload sensing means for disabling said engine responsive to an overload condition in said clutch actuating means.

5. An engine automatic control circuit for an internal combustion engine and clutch assembly, said circuit comprising:

timer means for determining alternating first and second periods of time such that said first period being when said engine is operable and said second period being when said engine is disabled from fully operating;

starter means responsive to said timer means for starting the engine near the beginning of each first period of time;

actuating means responsive to said timer means for engaging said clutch after said starter means starts said engine;

shut down means responsive to said timer means for shutting the engine off at the beginning of each second period of time; and overload sensing means for disabling said engine responsive to an overload in said actuating means.

6. An engine automatic control circuit for an internal combustion engine, said circuit comprising:

a first timer means for determining an alternating first period of time when the engine is allowed to run and a second period of time when the engine is disabled from fully operating;

a second timer means for determining the time between successive cranks of the engine by a starter motor when the circuit means is actuated at the beginning of each first period of time;

a third timer means for adjustably determining the duration of each crank of said starter motor;

a means for preventing any successive crank when the engine is running; and shut down means responsive to said first timer for shutting off said engine during the second period of time.

7. An engine automatic control circuit as defined in claim 6 further comprising:

a clutch actuating means for engaging a clutch to said engine after said engine has commenced running near the beginning of the first period of time.

8. An engine automatic control circuit as defined in claim 6 further comprising:

a warm up timer means for allowing the engine to run for a warm up period of time before said clutch actuating means engages said clutch to said engine.

9. An engine automatic control circuit as defined in claim 6 further comprising:

a liquid coolant level sensor for sensing level of liquid coolant in said engine;

a coolant temperature sensor for sensing the temperature of said liquid coolant;

an oil pressure sensor for sensing the oil pressure in said engine;

means for disabling said engine when said respective sensors sense said liquid coolant level is below a predetermined level or said coolant temperature is above a predetermined temperature or said oil pressure is below a predetermined minimum.

10. An engine automatic control circuit as defined in claim 6 further comprising:

a liquid coolant sensor for sensing coolant in said engine;

an oil sensor for sensing said oil in said engine;

means for disabling said engine when said liquid coolant sensor or said oil sensor senses an undesirable condition of said respective liquid coolant or oil.

11. An engine automatic control circuit for an internal combustion engine, said circuit comprising:

timer means for determining alternating first and second periods of time, said first period of time being when said engine is operable and said second period being when said engine is disabled from fully operating;

starter means responsive to said first timer means for starting the engine near the beginning of each first period of time; said starter means includes:

a starter motor;

automatic switch means responsive to said first timer means to close and deliver power to said starter motor for a predetermined length of time;

limiter means for limiting the number of times said automatic switch means closes in any given first period of time; and said limiter means being adjustable to adjust the maximum number of times said automatic switch means closes; and shut down means responsive to said first timer for shutting off said engine during said second period and being deactuated during said first period of time.

12. An engine automatic control circuit as defined in claim 11 wherein said predetermined length of time determined by said automatic switch means is adjustable.

13. An engine automatic control circuit as defined in claim 11 further comprising:

a clutch actuating means for engaging a clutch and for disengaging said clutch;

a manually operable switch means operatively connected to the actuating means and positionable in a disengage position or automatic position such that when said switch means is in the automatic position, said clutch actuating means is responsive to said first timer for engaging the clutch near the beginning of each first period of time after said engine commences running and for disengaging said clutch at the beginning of each second period of time; and when said switch means is in the disengage position, said actuating means disengages said clutch.

14. An engine automatic control circuit as defined in claim 13 wherein:

said manually operable switch means is positionable in an override position such that when said switch means is in said override position said actuating means engages said clutch assembly.

15. An engine automatic control circuit as defined in claim 11 further comprising:

a clutch actuating means for engaging a clutch to said engine after said engine has commenced running near the beginning of each first period of time.

16. An engine automatic control circuit as defined in claim 15 further comprising:

a supplemental timer for determining alternating third and fourth periods of time within said second period of time, said third period when the engine is shut off and said fourth period when said engine is allowed to run with said clutch remaining disengaged;

said automatic switch means being responsive to said supplemental timer to deliver power to said starter motor for a predetermined length of time at the beginning of each fourth period of time;

said limiter means limits the number of times said automatic switch means closes and delivers power in any given fourth period of time;

said shut down means being responsive to said supplemental timer for shutting the engine off at the beginning of each third period of time and being deactuated during said fourth period of time.

17. An engine automatic control circuit as defined in claim 14 wherein said predetermined length of time determined by said automatic switch means is adjustable.

18. An engine automatic control circuit for an internal combusion engine and clutch assembly, said circuit comprising:

a timer means for determining alternating first and second time periods such that said first time period being when said engine is allowed to fully operate and said second period being when said engine is disabled from fully operating;

starting means responsive to said first timer means for starting the engine near the beginning of each said first time period;

clutch actuating means for engaging the clutch and for disengaging said clutch;

a manually operable switch means operatively connected to the actuating means and positionable in a disengage position or automatic position such that when said switch means is in the automatic position, said actuating means is responsive to said first timer for engaging the clutch near the beginning of each first period of time and for disengaging said clutch at the beginning of each second period of time, and said actuating means disengages said clutch when said switch means is in the disengage position.

19. An engine automatic controller circuit as defined in claim 18 wherein:

said manually operable switch means is positionable in an override position such that when said switch means is in said override position said actuating means engages said clutch assembly.

* * * * *